US009567050B2

(12) United States Patent
Liu

(10) Patent No.: US 9,567,050 B2
(45) Date of Patent: Feb. 14, 2017

(54) HUMAN-POWERED UNDERWATER PROPULSOR

(71) Applicant: Ting Fong Liu, New Taipei (TW)

(72) Inventor: Ting Fong Liu, New Taipei (TW)

( * ) Notice: Subject to any disclaimer, the term of this patent is extended or adjusted under 35 U.S.C. 154(b) by 0 days.

(21) Appl. No.: 14/919,078

(22) Filed: Oct. 21, 2015

(65) Prior Publication Data

US 2016/0340011 A1 Nov. 24, 2016

(30) Foreign Application Priority Data

May 22, 2015 (TW) ..... 104207962 U

(51) Int. Cl.

| | |
|---|---|
| ***B63C 11/46*** | (2006.01) |
| ***B63H 16/20*** | (2006.01) |
| ***B63G 8/00*** | (2006.01) |
| *B63C 11/18* | (2006.01) |
| *B63C 11/02* | (2006.01) |
| *B63C 11/12* | (2006.01) |
| *B63C 11/30* | (2006.01) |

(52) U.S. Cl.

CPC ..... *B63H 16/20* (2013.01); *B63G 8/001* (2013.01); *B63C 11/12* (2013.01); *B63C 11/18* (2013.01); *B63C 11/30* (2013.01); *B63C 2011/027* (2013.01); *B63H 2016/202* (2013.01)

(58) Field of Classification Search

CPC ..... B63C 11/46; B63H 16/20; B63G 8/001; A63B 35/00; A63B 35/02

See application file for complete search history.

(56) References Cited

U.S. PATENT DOCUMENTS

| | | | | | |
|---|---|---|---|---|---|
| 1,324,961 | A | * | 12/1919 | Grantham | B63G 8/24 114/330 |
| 1,530,560 | A | * | 3/1925 | Heminger | A63B 35/02 441/55 |
| 2,936,729 | A | * | 5/1960 | Kuttner | A63H 23/02 114/67 A |
| 3,160,133 | A | * | 12/1964 | Walker | A63H 23/00 114/245 |
| 3,618,551 | A | * | 11/1971 | Deslierres | B63G 8/00 114/315 |
| 6,079,348 | A | | 6/2000 | Rudolph | |

(Continued)

FOREIGN PATENT DOCUMENTS

| | | | |
|---|---|---|---|
| CN | 1376616 | A | 10/2002 |
| TW | 478527 | U | 5/2014 |

*Primary Examiner* — Stephen Avila

(74) *Attorney, Agent, or Firm* — Muncy, Geissler, Olds & Lowe, P.C.

(57) ABSTRACT

A human-powered underwater propulsor for user's moving in water mainly has a power generating module provided within a receiving space inside a waterproof airbag, and the power generating module is coupled to a propulsion unit. The receiving space is formed with an opening end provided with a waterproof ring to be worn by user in such a manner that the receiving space is hermetically sealed to prevent water from entering the receiving space during diving. When user pedals by stepping on two pedals of the power generating module, the power generating module is actuated to cause the flapping of the propulsion unit. Hence, the human-powered underwater propulsor allows user to exercise his feet in the air to reduce drag in diving so that user can moves more easily in the water.

7 Claims, 7 Drawing Sheets

(56) References Cited

U.S. PATENT DOCUMENTS

| | | | | |
|---|---|---|---|---|
| 6,524,145 | B1 * | 2/2003 | Arzate | A63B 35/02<br>114/315 |
| 6,561,862 | B1 * | 5/2003 | Moore | A63B 35/02<br>440/14 |
| 6,615,761 | B2 * | 9/2003 | Wyman | B63C 11/46<br>114/315 |
| 8,322,296 | B2 * | 12/2012 | Tiraby | B63G 8/001<br>114/337 |

* cited by examiner

HUMAN-POWERED UNDERWATER PROPULSOR

BACKGROUND OF INVENTION

Field of the Invention

The present invention relates to a human-powered underwater propulsor, more particularly to a human-powered underwater propulsor in which a hermetic receiving space is generated after an airbag is worn by user, and the receiving space has a power generating module provided therein for driving a propulsion unit to flap so as to enable underwater advancing.

Brief Description of Prior Art

The most often used technology in underwater operations such as sea exploration, ecological observation in the sea is diving. Diving can be done either by using a diver propulsion vehicle or by wearing diving equipment (scuba diving), wherein the diver propulsion vehicle can protect diver but cannot operate precise or delicate actions. To facilitate the operation, most of the divers wear diving apparatus to resist underwater low temperature and flippers to increase underwater moving speed. However, as water resistance is far greater than air resistance, diver wearing flippers still needs to spend considerable effort to move smoothly in water. Since underwater environment is different from land environment, divers facing dangerous underwater environment have to spend physical exertion more rapidly.

In order to solve the problem of rapid physical exertion caused by water resistance, concerned industry has proposed a diving apparatus for surrounding a diver inside, such as US Patent Gazette No. 6079348 entitled "Diving apparatus and method for its production", in which the apparatus has a hollow body with streamline shape for reducing the resistance of underwater moving. One end of the hollow body is formed with a propulsion fin. A receiving space is further formed in the interior of the hollow body for fully accommodating a diver's whole body therein. The feet of the diver can be connected to the propulsion fin provided on the hollow body through fixed shoes. When the feet of the diver is flapping, the propulsion fin can be advanced in water accompany with the flapping movement of diver's feet.

In addition, two more prior arts are listed below for reference.

(1) Taiwanese Patent Gazette No. M478527 entitled "Protective sleeve of effort-saving fin"

(2) China Patent Gazette No. CN1376616 entitled "Dive Boat having ultra mobility"

It is apparent from the above prior arts, diver located inside the streamline hollow body can move through the flapping motion of propulsion fin activated by the flapping movement of diver's feet. However, it is not convenient for diver's flapping and it is very difficult for diver located inside the hollow body to perform a variety of actions for precise operations. Therefore, this technology needs further improvement.

SUMMARY OF THE INVENTION

In view of the problems and demands, the main object of the present invention is to provide a human-powered underwater propulsor by which user conducting underwater activity can reduce physical exertion due to the reduction of water resistance and perform underwater operation flexibly.

In order to achieve above objects, the human-powered underwater propulsor of the present invention has a waterproof airbag and a power generating module, wherein the waterproof airbag has a receiving space provided internally, an open end being formed on one end of the receiving space and a waterproof ring being provided on the open end in such a manner that the receiving space is hermetically sealed after the user wears the waterproof airbag. One end of the waterproof airbag has a propulsion unit provided therein. The power generating module is assembled in the receiving space and has a gear box with two cranks connected respectively on both sides thereof. Each end of the two cranks has a pedal assembled thereon for pedaling by user. When user conducts pedaling, the gear box is actuated to allow a swing rod provided on one end of the gear box to swing. As the swing rod is connected to the propulsion unit, the propulsion unit is allowed to flap so as to move forward in water, when the swing rod is swung.

DETAILED DESCRIPTION OF PREFERRED EMBODIMENTS

Figure 1:
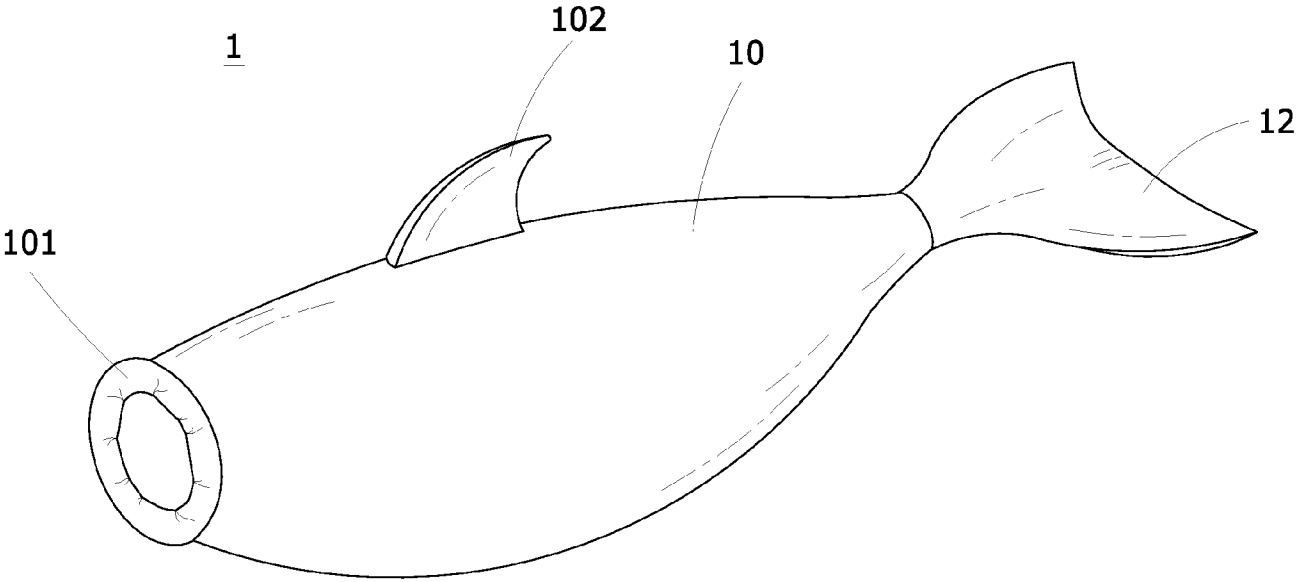
FIG. 1 is a perspective view of the appearance of the present invention.

FIG. 1 is a perspective view of the appearance of the present invention. As shown in the figure, the human-powered underwater propulsor 1 of the present invention is formed by a waterproof airbag 10 and a propulsion unit 12, when viewed from appearance. The waterproof airbag 10 has a receiving space formed therein, one end of the receiving space is formed with an open end and a waterproof ring 101 is provided on the open end. When an user 2 wears the human-powered underwater propulsor 1, the waterproof ring 101 can allow the receiving space to form hermetically sealed state so as to prevent the water from entering into the receiving space in diving. The other end of the waterproof airbag 10 has a propulsion unit 12, the appearance of which is formed as a tail fin of fish so as to obtain more propulsion force in diving. Furthermore, the waterproof airbag 10 also has a back fin 102 provided on the external upper side thereof. The function of the back fin 102 is to increase the stability of propulsion so that the advancing direction can be easily controlled.

Figure 2:
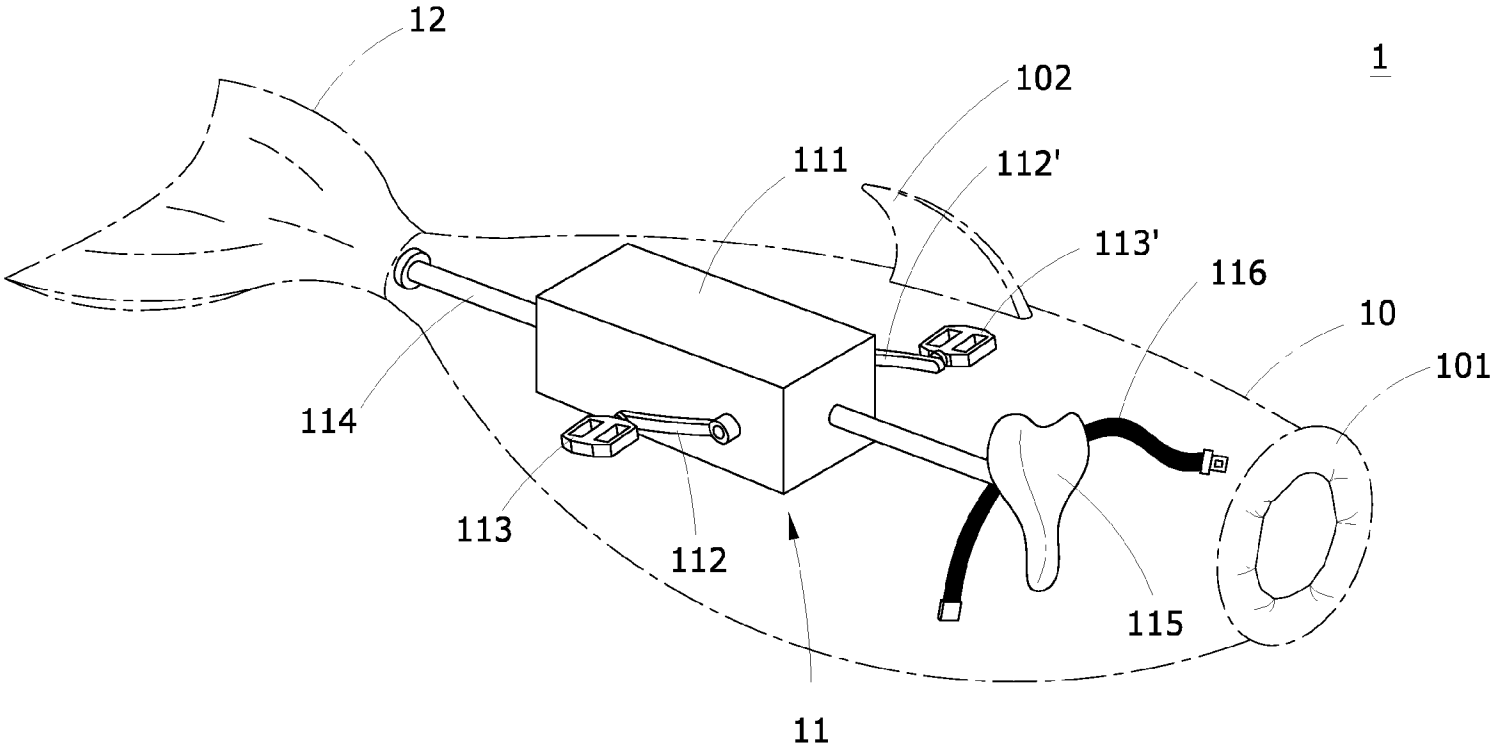
FIG. 2 is a perspective view of the structure of the present invention.
Figure 3:
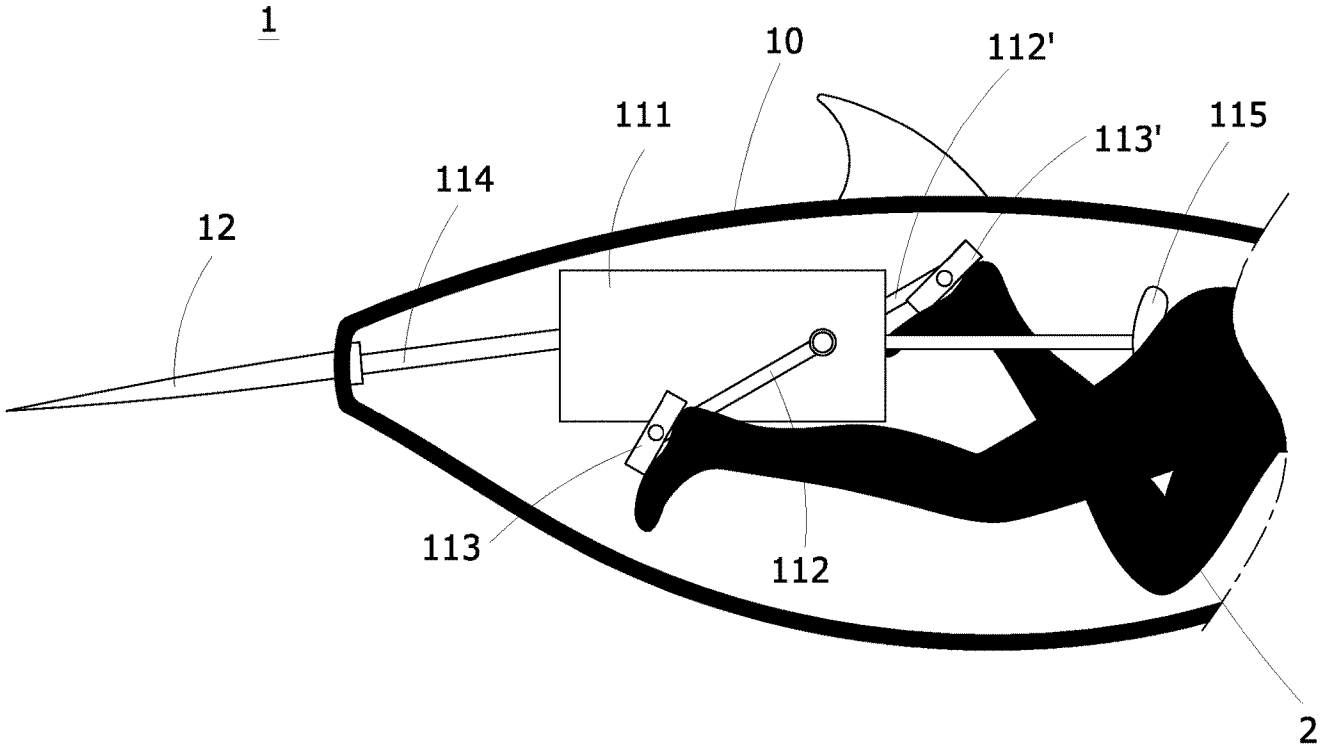
FIG. 3 is a schematic view (I) of the first embodiment of the present invention.
Figure 4:
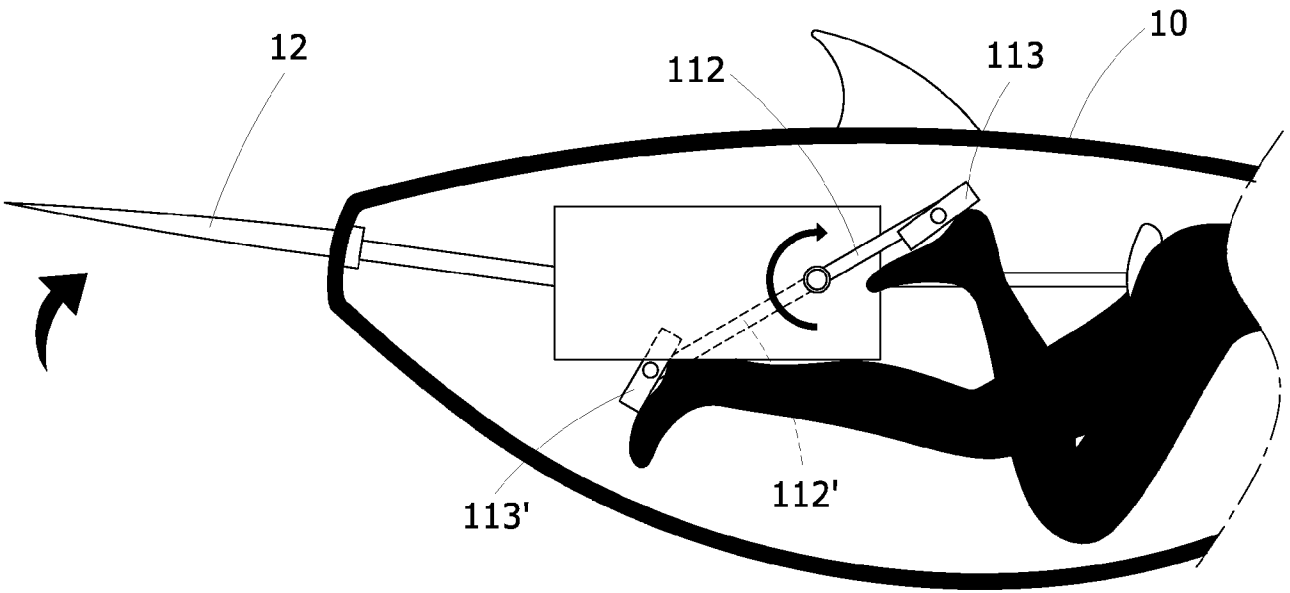
FIG. 4 is a schematic view (II) of the first embodiment of the present invention.
Figure 5:
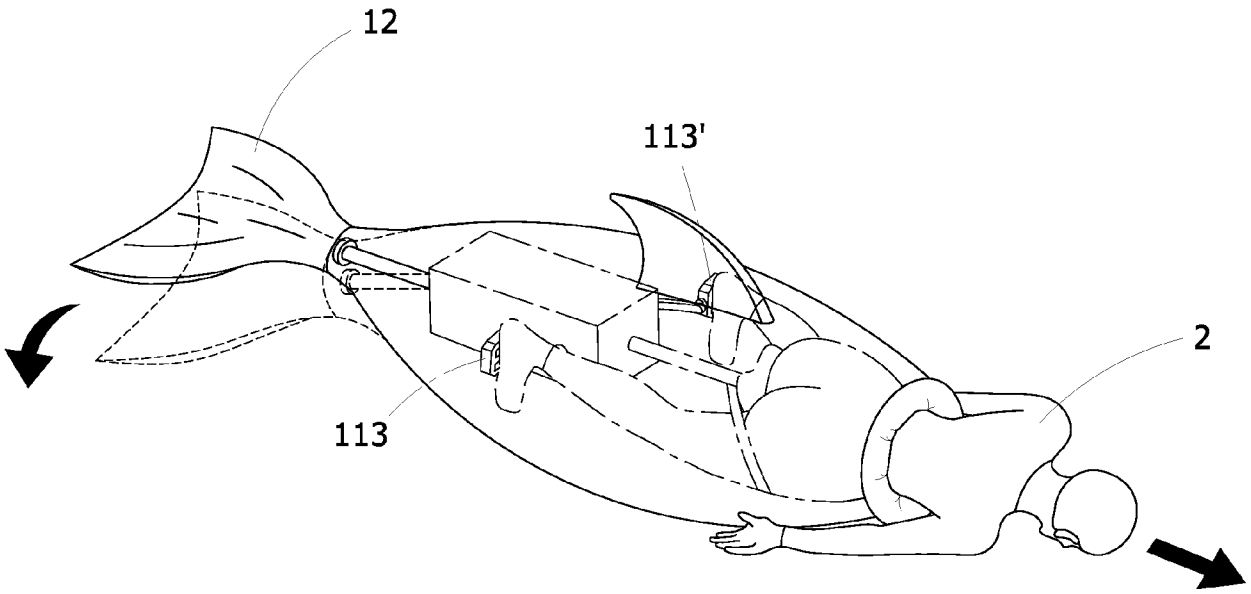
FIG. 5 is a schematic view (III) of the first embodiment of the present invention.

Referring to FIG. 2, the waterproof airbag 10 has a receiving space provided therein, and a power generating module 11 for supplying required power to drive the human-powered underwater propulsor 1 in water is provided in the receiving space. The power generating module 11 includes a gear box 111 which has cranks 112,112' respectively assembled on both sides. Pedals 113, 113' are assembled respectively on the cranks 112,112' for pedaling by user 2. One end of the gear box 111 is connected with a swing rod 114 which is connected to the propulsion unit 12. The other end of the gear box 111 is assembled with a saddle 115 for user 2 to sit thereon. A safety belt 116 is further provided below the saddle 115 for restricting user 2 on the saddle 115. In this manner, user can sit on the saddle 115 stably during pedaling process. Referring to FIGS. 3 and 4, after the user 2 wears the human-powered underwater propulsor 1, the buttock of the user 2 sits on the saddle 115 and the feet are in the receiving space so as to stampede on the pedals 113,113' on both sides. When the user 2 conducts pedaling by stepping on the pedals 113,113', the two cranks 112,112' assembled on the pedals 113,113' drive the gear box 111 which then drives the swing rod 114 to swing, and thus the propulsion unit 12 connected to the swing rod 114 can perform flapping motion. Referring to FIG. 5, after the user 2 wears the human-powered underwater propulsor 1, user's lower body is located inside the waterproof airbag 10, and the waterproof ring 101 provided on the open end of the waterproof airbag 10 prevents water from entering into the interior of the waterproof airbag 10, so that the receiving space can be hermetically sealed (i.e., the interior of the waterproof airbag 10 is full of air even in water). As user's lower body is in the hermetic receiving space, the user 2 can pedal to enable flapping of the propulsion unit 12 for moving forward quickly in water without being affected by external water resistance, by stepping on pedals 113,113'. Therefore, the human-powered underwater propulsor 1 allows user 2 to conduct underwater movement with less physical force.

Figure 6:
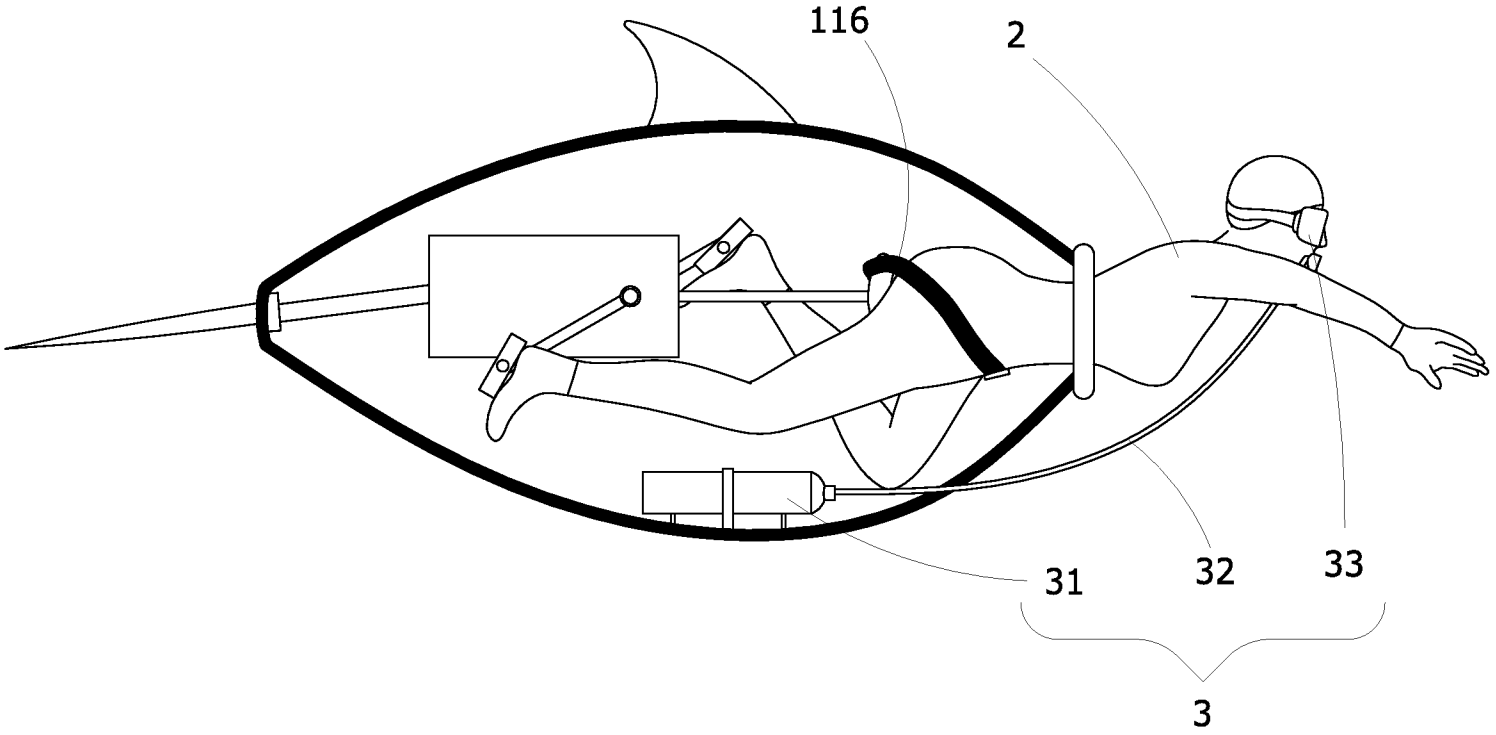
FIG. 6 is a schematic view (I) of another embodiment of the present invention.
Figure 7:
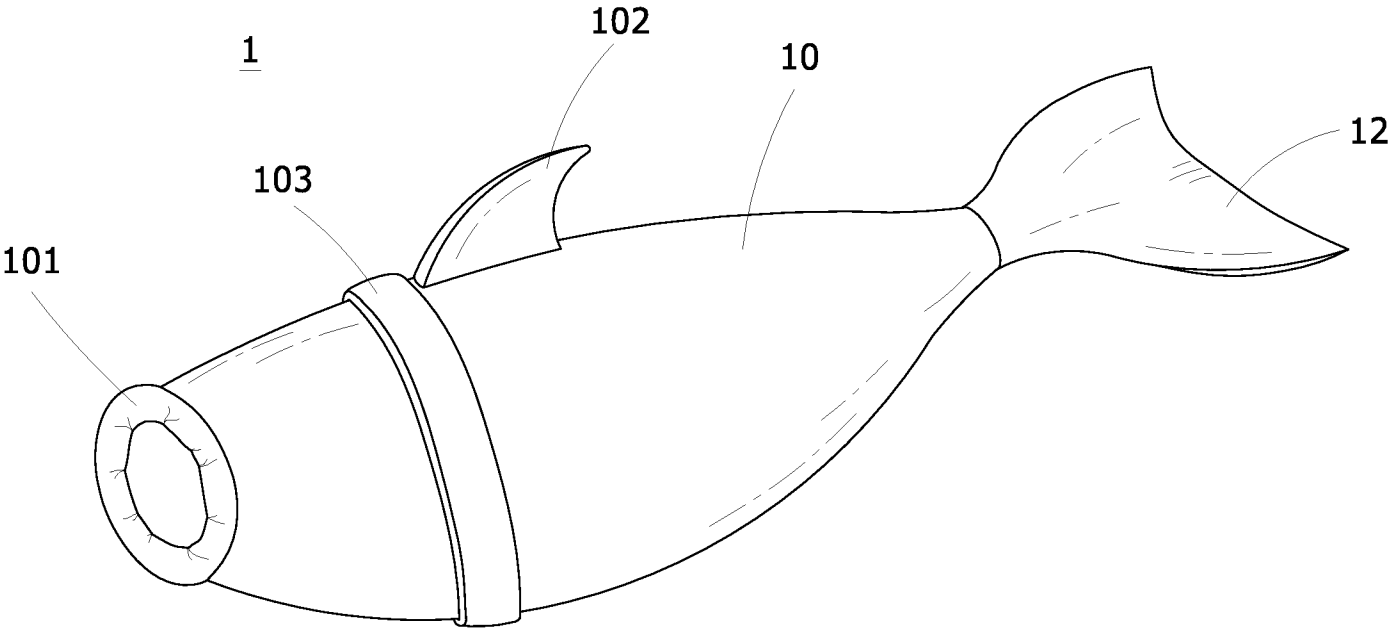
FIG. 7 is a schematic view (II) of another embodiment of the present invention.

Referring to FIG. 6, the human-powered underwater propulsor 1 is provided with an oxygen supply system 3 which includes am oxygen bottle 31, a hose 32 and an oxygen mask 33, wherein the oxygen bottle 31 is provided in the receiving space of the waterproof airbag 10, and is connected to the oxygen mask 33 through the hose 32, so as to supply required oxygen gas to the user 2 wearing the oxygen mask 33. In this way, it is more advantageous for the user 2 to perform long-time operation in water. As shown in FIG. 7, the waterproof airbag 10 is formed with a lifebuoy 103 which is normally in uninflated state. The lifebuoy 103 is connected to the oxygen bottle 31 through the hose 32 on which a valve (not shown) is provided. When the user 2 is suddenly in emergency condition, the valve is pulled to open so that the lifebuoy 103 is inflated with oxygen through the hose 32 and then allows the user 2 to surface quickly.

Based on foregoing, the human-powered underwater propulsor of the present invention has a waterproof airbag wherein a receiving space is provided internally, an open end being formed on the receiving space and a waterproof ring being provided on the open end in such a manner that the receiving space is hermetically sealed after user wears the waterproof airbag. Furthermore, one end of the waterproof airbag has a propulsion unit provided therein, and a power generating module is assembled in the receiving space, the power generating module has a gear box with two cranks being connected respectively on both sides thereof. Each end of the two cranks has a pedal assembled thereon for pedaling by user. One end of the gear box is connected with a swing rod which is connected to the propulsion unit. The other end of the gear box is assembled with a saddle for user to sit thereon. After user wears the waterproof airbag, the lower body of the user is in the waterproof airbag and the buttock of the user sits on the saddle, and conducts the pedaling so that the gear box is actuated to drive the swing rod to swing and then to allow the propulsion unit to flap. Therefore, user can move quickly in the water. In this manner, the present invention, after implementation according to abovementioned, surely can achieve the object of providing a human-powered underwater propulsor by which user conducting underwater activity can reduce physical exertion due to the reduction of water resistance and perform underwater operation flexibly.

While the present invention has been described by preferred embodiments in conjunction with accompanying drawings, it should be understood that the embodiments and the drawings are merely for descriptive and illustrative purpose, not intended for restriction of the scope of the present invention. Equivalent variations and modifications conducted by person skilled in the art without departing from the spirit and scope of the present invention should be considered to be still within the scope of the present invention.

The invention claimed is:

1. A human-powered underwater propulsor, comprising a waterproof airbag having a receiving space provided internally, an open end being formed on said receiving space and a waterproof ring being provided on said open end in such a manner that said receiving space is hermetically sealed after user wears the waterproof airbag; furthermore, a propulsion unit being provided on the other end of said waterproof airbag;

a power generating module which has a gear box being provided in said receiving space, said power generating module having a gear box with two cranks being connected respectively on both sides thereof, each end of the two cranks having a pedal assembled thereon for pedaling by user; one end of the gear box being connected with a swing rod which is connected to the propulsion unit; the other end of the gear box being assembled with a saddle for user to sit thereon;

after user wears said waterproof airbag, the buttock of the user sits on the saddle and user's feet pedal to actuate said gear box so that said swing rod is actuated to drive the propulsion unit to flap.

2. The human-powered underwater propulsor as claimed in claim 1, wherein a back fin is provided on the external upper side of said waterproof airbag for increasing the stability of said human-powered underwater propulsor moving in water.

3. The human-powered underwater propulsor as claimed in claim 1, wherein said human-powered underwater propulsor is provided with an oxygen supply system.

4. The human-powered underwater propulsor as claimed in claim 3, wherein said oxygen supply system comprises an oxygen bottle, a hose and an oxygen mask, said oxygen bottle being provided within said receiving space and being connected to said oxygen mask through said hose so as to supply oxygen gas required by user wearing said oxygen mask.

5. The human-powered underwater propulsor as claimed in claim 4, wherein said waterproof airbag has a lifebuoy formed outside, said lifebuoy being connected to said oxygen bottle through said hose so as to be inflated with oxygen gas from said oxygen bottle.

6. The human-powered underwater propulsor as claimed in claim 5, wherein a valve is provided on said hose, said valve being used for opening or closing said oxygen bottle so as to control the inflation of said lifebuoy.

7. The human-powered underwater propulsor as claimed in claim 1, wherein a safety belt is provided below said saddle for restricting user on said saddle.

* * * * *